United States Patent [19]

Davis

[11] 4,094,525

[45] June 13, 1978

[54] ROLLER SKATE TOE STOP CONVERTER

[75] Inventor: Cecil E. Davis, Tulsa, Okla.

[73] Assignee: Unarco Industries, Inc., Chicago, Ill.

[21] Appl. No.: 792,698

[22] Filed: May 2, 1977

[51] Int. Cl.[2] ..... A63C 17/14

[52] U.S. Cl. ..... 280/11.2

[58] Field of Search ..... 280/11.2, 11.27, 11.28; 16/2, 3; 151/28

[56] References Cited

U.S. PATENT DOCUMENTS

| | | | |
|---|---|---|---|
| 2,595,751 | 5/1952 | Balstad | 280/11.28 |
| 2,706,641 | 4/1955 | Van Horn | 280/11.2 |
| 2,719,723 | 10/1955 | Ware | 280/11.2 |
| 3,003,776 | 10/1961 | Ware | 280/11.2 |
| 3,035,846 | 5/1962 | Asad | 280/11.2 |
| 3,180,651 | 4/1965 | Ware | 280/11.2 |
| 3,868,121 | 2/1975 | Ware | 280/11.2 |

*Primary Examiner*—Joseph F. Peters, Jr.
*Assistant Examiner*—Gene A. Church
*Attorney, Agent, or Firm*—Dressler, Goldsmith, Clement, Gordon & Shore, Ltd.

[57] ABSTRACT

An adjustable roller skate toe stop converter is provided for a roller skate having a toe stop mounting shoulder defining a threaded toe stop mounting bore of a first predetermined diameter adapted to receive and threadingly engage a threaded mounting stud of a first toe stop. The converter converts the skate for use with a second toe stop having a threaded mounting stud of a diameter larger than the mounting stud of the first toe stop. The converter comprises a generally cylindrical block having on one end a small bore and on the other end a large bore, the large and small bores communicating in coaxial alignment to define an annular shoulder between them. A bolt is introduced into the block and is threaded into the toe stop mounting bore of the roller skate to mount the block thereagainst with the head of the bolt bearing upon the annular shoulder in the block. The mounting stud of a second toe stop may then be threaded in the larger bore of the block to position the toe stop at a distance from the block that is variable with the amount of thread engagement. A flexibly hinged wall portion of the block can be clamped tight against the stud of the second toe stop by means of a bolt threaded between the flexibly hinged wall and the remainder of the block for tightening and holding the hinged wall against the stud to lock the toe stop at the desired position and prevent rotation thereof.

5 Claims, 8 Drawing Figures

FIG. 1
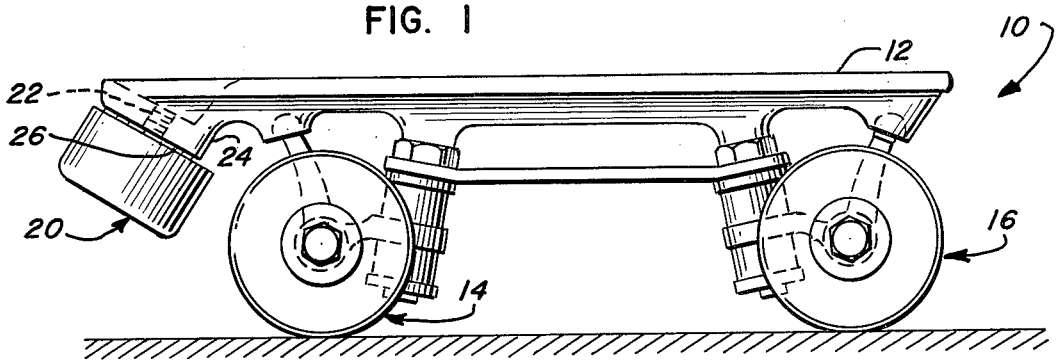
FIG. 2
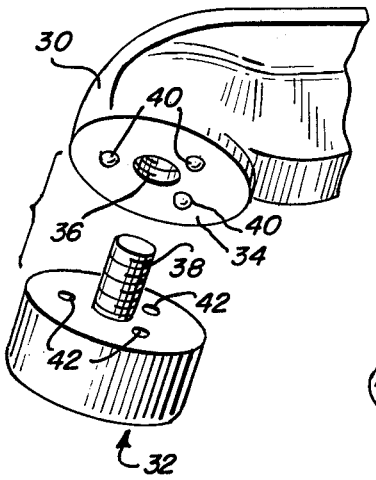
FIG. 3
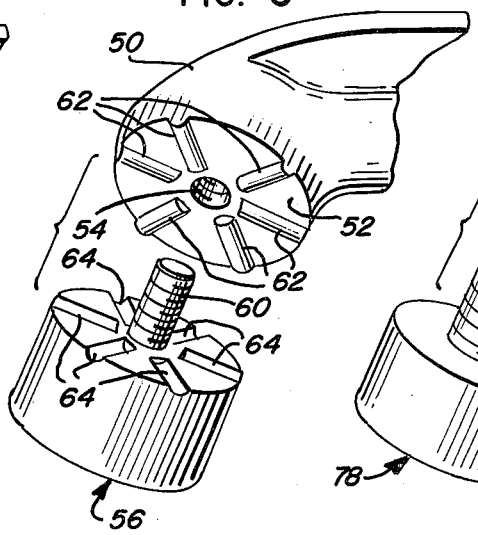
FIG. 4
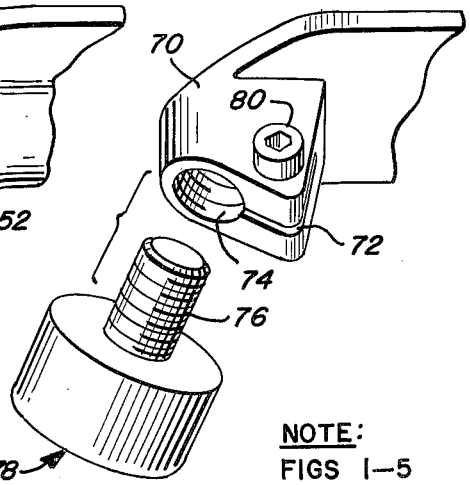
NOTE:
FIGS 1—5 SHOW PRIOR ART
FIG. 5
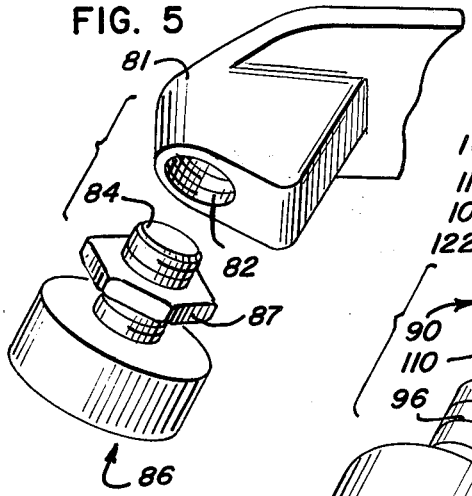
FIG. 6
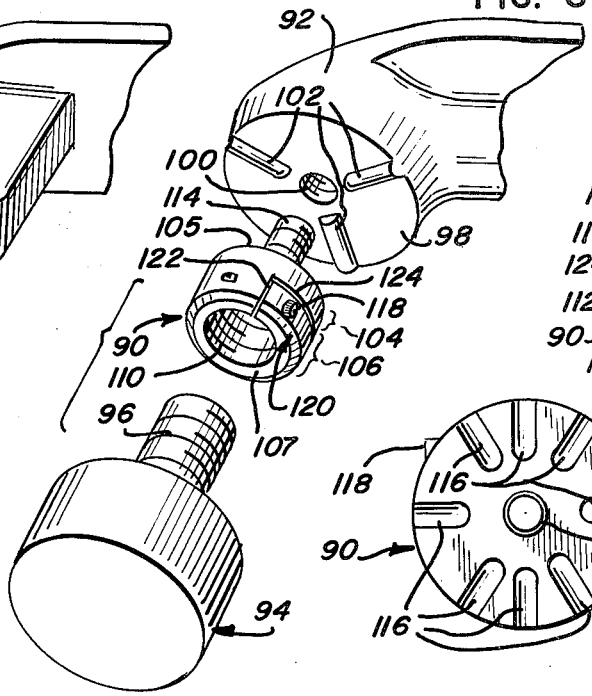
FIG. 7
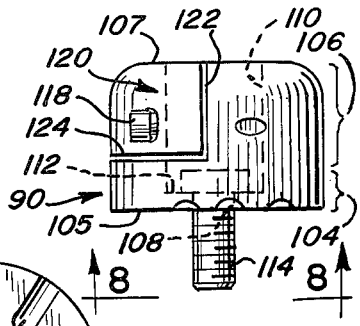
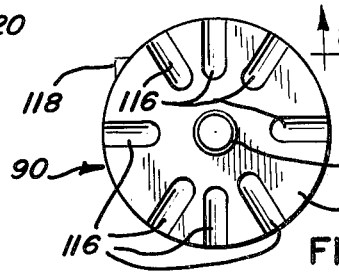
FIG. 8

ROLLER SKATE TOE STOP CONVERTER

BACKGROUND OF THE INVENTION

This invention relates to roller skates and more particularly to roller skates having an integral toe stop mounting structure defining a toe stop mounting bolt receiving bore of a given predetermined diameter.

A toe stop is a device mounted on the front of a roller skate and which has a high friction factor relative to the surface on which the roller skate is used so that, by tilting the skate forward, the toe stop may strike the surface and inhibit further movement of the skates. This is advantageous in certain roller skating activities.

Various types of roller skate toe stops and roller skate toe stop mounting assemblies have been developed over the years. Today, toe stops are commonly made of rubber and are in the form of cylinders or hemispheres which can be secured to a downwardly and forwardly facing toe stop support structure or mounting shoulder on the roller skate by means of a threaded bolt or machine screw.

It has been found that in use, a toe stop may rotate about its mounting bolt, or, if the mounting bolt is integral with the toe stop, the toe stop and bolt may rotate within the mounting bore in the roller skate toe stop support structure. This rotation can cause loosening of the toe stop and can cause the toe stop to become displaced from the desired position on the front of the roller skate (e.g., the toe stop may loosen and move closer to the floor). Further, a loose toe stop can cause the roller skater to rotate slightly relative to the toe stop when the skater tilts the skate and engages the stop with the floor. In general, none of these occurrences is desirable.

There are two basic mounting combinations of a roller skate and toe stop. One is the roller skate with the fixed, non-adjustable toe stop mounting structure. The second is the roller skate with the adjustable toe stop mounting structure.

The roller skate manufacturing industry has developed over the years to the point where most of the fixed, non-adjustable toe stop roller skates have a toe stop receiving bore of $\frac{1}{4}$ inch diameter adapted to receive a threaded $\frac{1}{4}$ inch toe stop mounting bolt. The adjustable toe stop roller skates use a larger, $\frac{5}{8}$ inch diameter threaded bore for receiving a $\frac{5}{8}$ inch diameter adjustable toe stop mounting bolt. For the adjustable toe stop, the industry has standardized on the larger, $\frac{5}{8}$ inch diameter mounting bolt in order to provide the required strength and in order to provide a structural member of sufficient size that can be adequately locked in place in the roller skate.

Specifically, with an adjustable toe stop, the distance between the floor on which the roller skate is placed and the bottom of the toe stop is variable within a certain range. This adjustability accommodates the needs of the individual using the skates who may desire to vary the distance depending upon whether he is skating for pleasure, in exhibition, or competitively. Although a number of different types of assemblies have been incorporated for roller skates adapted to use adjustable toe stops, the industry has generally standardized on the $\frac{5}{8}$ inch diameter stud mounted toe stop for use with a roller skate having an integral, adjustable toe stop support structure.

In the United States, between 1945 and 1950, many roller skate manufacturers began to offer roller skates with the integral toe stop mounting structures or shoulder similar to those discussed above. Some of the roller skates were adapted to receive a non-adjustable toe stop and other roller skates were adapted to receive the adjustable toe stops. Some manufacturers offered both types of roller skates. However, up until the present invention, there has been no way for an owner of a roller skate with a non-adjustable toe stop mounting bore to use the adjustable toe stops having the larger toe stop mounting studs.

Roller skates with integral, adjustable toe stop support structures are much more expensive than roller skates with integral non-adjustable toe stop support structures. In fact, the retail cost of many of the roller skates with the adjustable toe stop mounting shoulder is almost twice the cost of the skates with the non-adjustable toe stop mounting shoulder. As a consequence, it would be desired to provide an inexpensive adapter or converter for converting a roller skate having a non-adjustable toe stop support structure to one having an adjustable toe stop support structure which could accommodate the larger diameter mounting studs of the adjustable toe stops.

Roller skates having non-adjustable toe stop support structures frequently incorporate, on the surface of the support structure which bears against the toe stop, an array of projections for engaging mating recesses in the toe stop. Consequently, an adapter or converter which would mount to a roller skate having such projections must be able to accommodate a variety of projection designs. It would be desirable to provide a roller skate toe stop adapter or converter which could accommodate such anti-rotation projections on a roller skate toe stop support structure.

In the past, adapters have been provided in the form of bushings which can be threadingly engaged in "large" diameter toe stop mounting bores for receiving toe stops having mounting bolts of a smaller diameter. However, with the advent of the standardization of the $\frac{1}{4}$ inch diameter toe stop mounting bore in the skate having a non-adjustable toe stop support structure and with the advent of the standardization of the $\frac{5}{8}$ inch diameter toe stop mounting bore in the more expensive skate having an adjustable toe stop support structure, there is need for providing an adapter which can be used with the skate having the non-adjustable toe stop support structure and 10 inch bore to convert that skate to one having an adjustable toe stop support structure which can accommodate the $\frac{5}{8}$ inch mounting bolt. $\frac{1}{4}$ This will enable an owner of the less expensive, non-adjustable toe stop support structure roller skate to use the adjustable toe stops without buying a second pair of more expensive roller skates specifically designed with the adjustable, integral toe stop support structure. Such a toe stop adapted or converter could be specifically designed to mount the larger, $\frac{5}{8}$ inch diameter mounting stud of the toe stops now being sold for the more expensive roller skates having the adjustable toe stop support structure. This of course will allow the owner of a roller skate having a non-adjustable integral toe stop support structure to use the adjustable toe stops currently on the market and to take advantage of the increased strength and anti-rotation locking efficiency obtained by the use of the larger $\frac{5}{8}$ inch diameter mounting stud.

SUMMARY OF THE INVENTION

A unique, adjustable toe stop converter for roller skates is provided which may be used with a roller skate having an integral toe stop support structure and first threaded receiving bore of a predetermined size for receiving the mounting bolt of a first toe stop. The converter converts the skate to an assembly which has a bore of an increased, or larger diameter for receiving a larger threaded mounting bolt of a second, adjustable toe stop and which has a mechanism for adjusting the elevation of the second toe stop with respect to the floor and for locking the toe stop in place.

Specifically, a counterbored member or cylinrical block is provided with two end walls and is adapted to be secured to the skate with a mounting bolt. One end wall defines a bore (a "second" bore relative to the "first" bore in the skate) which is equal to, or a little larger than, the first bore in the skate toe stop support structure or mounting shoulder and is adapted to matingly bear against the toe stop mounting shoulder of the skate. The other end wall defines a third bore which communicates, and is coaxial with the second bore to define an annular shoulder between the second and third bores. A bolt is inserted in the counterbored member with the shank projecting through the second bore and is threadingly engaged with the first bore in the roller skate toe stop mounting shoulder to secure the counterbored member thereagainst with the head of the bolt bearing against the annular shoulder in the counterbored member. The third bore is adapted to threadingly engage the larger diameter toe stop mounting stud to thereby secure the second toe stop to the counterbored member and hence to the roller skate.

The counterbored member has a means for securing the threaded mounting stud of the second toe stop against rotation within the third bore when the shank of the threaded mounting stud is threadingly engaged therewith. In this way, the amount of thread engagement between the mounting stud and the counterbored member can be set so that the bottom surface of the toe stop is at a desired distance from the floor. In a preferred form of the invention, the counterbored member has a flexibly hinged wall member defining a portion of the third bore. The flexibly hinged wall member is preferably defined by a slot running substantially parallel to the axis of the third bore and by another slot running substantially perpendicular to the axis of the third bore. A threaded clamp bolt or screw is secured between the flexibly hinged wall member and the remainder of the counterbored member for tightening and holding the wall member against the threaded stud of the second toe stop in the desired position at a distance from the counterbored member lower end wall that is variable with the amount of threaded engagement.

Preferably, the toe stop converter of the present invention is adapted to be used with a roller skate of the type having an integral non-adjustable toe stop mounting shoulder and receiving bore. Typically, in accordance with the general industry practice, the diameter of the threaded bore in a non-adjustable roller skate toe stop mounting shoulder is ¼ inch. Thus, the bolt of the present invention which secures the counterbored member to the roller skate is also ¼ inch diameter and is adapted to threadingly engage such a threaded bore. Since, in general, the industry has standardized upon a ⅝ inch diameter bore for the adjustable roller skate toe stop mounting shoulder and since the mounting studs of toe stops for use with such adjustable toe stop mounting shoulders are also necessarily ⅝ inch in diameter, the third, or larger, threaded bore of the counterbored member of the present invention is preferably also ⅝ inch in diameter to receive the toe stops with the ⅝ inch diameter mounting stud. Thus, a person who has already purchased a roller skate with a non-adjustable toe stop mounting shoulder need not purchase another pair of roller skates having an adjustable toe stop mounting shoulder. Rather, the person need merely attach the adjustable toe stop converter of the present invention to his roller skates.

In the preferred form of the roller skate toe converter of this invention, the unique, flexibly hinged wall portion of the counterbored member and the clamp screw provides a good clamping engagement of the large toe stop mounting stud and prevents unwanted rotation of the mounting stud with respect to the skate. Further, the flexibly hinged wall member may be easily loosened from engagement with the toe stop mounting stud to permit height adjustment of the toe stop with respect to the skate (and floor) and may easily be tightly engaged about the toe stop mounting stud by means of the clamp screw. This provides a more secure mounting which is less likely to loosen from the desired thread engagement than the type of stud mounting which incorporates a lock nut.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification, and in which like numerals are employed to designate like parts throughout the same, FIG. 1 is a side elevational view showing a skate with a toe stop mounted on the forward end;

FIG. 2 is a fragmentary, exploded view showing a non-adjustable toe stop mounting shoulder of a skate of the prior art and a toe stop adapted to be mounted thereon;

FIG. 3 is a fragmentary, exploded view of another non-adjustable toe stop mounting shoulder of a skate of the prior art and a toe stop adapted to be mounted thereon;

FIG. 4 is a fragmentary, exploded view of an adjustable toe stop mounting shoulder of a skate of the prior art and a toe stop adapted to be adjustably mounted thereon;

FIG. 5 is a fragmentary, exploded view of another toe stop mounting shoulder of a skate of the prior art and a toe stop adapted to be adjustably mounted thereon;

FIG. 6 is a fragmentary, exploded view of a toe stop mounting shoulder of the skate illustrated in FIG. 3, the toe stop converter of the present invention, and a toe stop adapted to be mounted thereon;

FIG. 7 is a side elevational view of the toe stop converter of the present invention oriented in a position generally upside down compared to its normal operating position on a roller skate; and FIG. 8 is a plan view taken along the plate 8—8 in FIG. 7.

DESCRIPTION OF THE PREFERRED EMBODIMENT

This invention may be used in many different forms. This specification and the accompanying drawings disclose only one specific form as an example of the use of the invention. The invention is not intended to be limited to the embodiment illustrated, and the scope of the invention will be pointed out in the appended claims.

For ease of description, the apparatus of the invention will be described in the normal operating position, that is, as secured to a roller skate with the roller skate mounted on its wheels upright on a floor, and terms such as upper, lower, horizontal, etc., will be used with reference to this normal operating position.

Referring now to the drawings, a roller skate 10 is shown in FIG. 1. The skate comprises a sole plate 12 and front and rear wheel truck assemblies, 14 and 16, respectively, which are constructed and connected with the sole plate 12 in a known manner. A toe stop 20 is secured to the front portion of the skate 10. Typically, a toe stop is molded from a rubber or rubber-like material and is secured by a bolt 22 through a bore in the toe stop to a toe stop mounting shoulder 24 which presents a generally downwardly and forwardly facing toe stop bearing surface 26. The specific structure of the toe stop 20 and of the toe stop bearing surface 26 varies from manufacturer to manufacturer and typical examples of these structures will next be described.

FIG. 2 illustrates a known roller skate toe stop mounting shoulder 30 and a toe stop 32 adapted to be mounted thereon. The shoulder 30, having a generally smooth bearing surface 34, defines a threaded bore 36. The toe stop 32 is mounted to the bearing surface 34 with mounting stud 38 which threadingly engages the bore 36. Typically, the stud 38 has a screw or bolt head seated within the toe stop 32 by which the stud 38 may be turned to threadingly engage the bore 36 and draw the toe stop tight against the bearing surface 34. To prevent rotation of the toe stop 32 relative to the skate, hemispherical projections 40 are provided to matingly engage hemispherical depressions 42 in the toe stop 32. With such projections being provided, bolt 38 must be rotatable with respect to stop 32.

Another type of known roller skate toe stop mounting shoulder and mating toe stop is illustrated in FIG. 3. The toe stop mounting shoulder 50, having a bearing surface 52, defines a bore 54. A toe stop 56 is provided with a bolt 60 for threadingly engaging the bore 54 and mounting the toe stop 56 tightly against the toe stop bearing surface 52. To prevent rotation of the toe stop relative to the skate, projecting ribs 62 are provided on the toe stop bearing surface 52 to matingly engage corresponding channels 64 in the toe stop 56. With such ribs 62 being provided, bolt 60 must be rotatable with respect to the toe stop 56.

It is to be noted that the toe stop mounting shoulders of the type illustrated in FIGS. 2 and 3 define, integral therewith, a threaded bore for engaging the mounting stud of the toe stop. This type of toe stop mounting is not adjustable. That is, the distance between the bottom of the toe stop and the floor remains constant when the toe stop is properly seated against the toe stop bearing surface. For this type of non-adjustable toe stop mounting structure, the roller skate industry has generally settled on a standard toe stop mounting stud size. Specifically, the size of the mounting stud and receiving threaded bore in the roller skate toe stop shoulder is $\frac{1}{4}$ inch in diameter. Roller skates having these non-adjustable toe stop mounting shoulders are relatively simple, and therefore, are less expensive than the more complicated adjustable mechanisms that will next be discussed.

FIGS. 4 and 5 illustrate roller skate and toe stop combinations which are adjustable. Taking FIG. 4 first, there is illustrated a roller skate toe stop mounting shoulder 70 which is essentially a split walled structure having a slot 72 on one side, which slot 72 communicates from the exterior of the shoulder 70 to a bore 74 in the interior of the shoulder. The bore 74 is threaded and adapted to receive a mounting stud 76 of a toe stop 78. The stud 76 is typically molded within the toe stop 78. The stud 76 is threadingly engaged with bore 74 so that the toe stop 78 may thereby be screwed into the skate to a position at some distance from the shoulder 70 and also at some distance above the floor. This distance is, of course, variable with the amount of thread engagement. When the desired amount of thread engagement has been achieved, the toe stop mounting shoulder 70 may be clamped tightly around the stud 76 by turning a clamp screw 80 which thereby compresses the portion of the shoulder on either side of the slot 72.

In FIG. 5, a toe stop mounting shoulder 81 defines a threaded bore 82 for receiving the threaded stud 84 of a toe stop 86. Like the toe stop of FIG. 4 discussed above, the toe stop 86 is adjustable with respect to the toe stop mounting shoulder 81 of the roller skate and hence, is adjustable in height with respect to the floor, by means of varying the amount of thread engagement between the stud 84 and the bore 82. When the desired amount of thread engagement has been achieved, a lock nut 87 on the stud 84 may be turned to butt against the shoulder 81 to prevent rotation of the stud 84 and the integrally connected toe stop 86 relative to the shoulder 81.

With the adjustable toe stop assemblies such as those described above and illustrated in FIGS. 4 and 5, the roller skate industry has standardized on the size of the toe stop mounting stud and toe stop mounting shoulder receiving bore. Specifically, the standard adjustable toe stop stud in use today is $\frac{5}{8}$ inch in diameter and the toe stop mounting shoulder receiving bore which is integral with the roller skate is necessarily $\frac{5}{8}$ inch in diameter to receive the toe stop mounting studs. It is to be noticed that the standard $\frac{5}{8}$ inch diameter adjustable toe stop studs in common use today are larger than the $\frac{1}{4}$ inch diameter non-adjustable toe stop studs in common use today. Further, roller skates designed to specifically receive the $\frac{5}{8}$ inch adjustable toe stops are more expensive than the roller skates adapted to receive the non-adjustable toe tops with the $\frac{1}{4}$ inch mounting stud. The toe stop converter of the present invention is designed to fit on the less expensive roller skate having a non-adjustable toe stop mounting shoulder with an integral $\frac{1}{4}$ inch diameter toe stop mounting bore and is designed to convert the skate to one capable of accepting the larger $\frac{5}{8}$ inch diameter stud of the adjustable toe stop. The converter of the present invention is further provided with an adjustment capability wherein the distance between the toe stop and the floor can be varied and set at a desired level.

The adjustable toe stop converter of the present invention is illustrated in FIG. 6 and is designated therein generally by numeral 90. The toe stop converter 90 is adapted to be attached to the toe stop mounting boss or bracket, such as shoulder 92 on the forward end of a roller skate and is further adapted to receive a "large" toe stop 94 which has a "large" diameter mounting stud 96.

For purposes of illustration, the converter 90 of the present invention is shown in FIG. 6 as being used with a skate having a toe stop mounting shoulder similar to that illustrated in FIG. 3. The roller skate mounting shoulder 92 has a generally downwardly and forwardly facing bearing surface 98 and defines a first threaded bore 100 of a diameter and thread equal to that of a threaded mounting stud of a first toe stop. The first toe stop is not illustrated in FIG. 6 but may be typically one of a number of different types of commercially produced toe stops, such as those illustrated in FIGS. 2 and 3 and previously described above. According to the standardization practices of the roller skate industry, the non-adjustable toe stop receiving bores, such as bore 100, which are integral with the toe stop mounting shoulder of the roller skate, are typically smaller (commonly ¼ inch in diameter) than the size required to matingly receive the larger mounting stud of the typical "adjustable" toe stop.

Many of the roller skates manufactured for use with the non-adjustable toe stops have anti-rotation protuberances incorporated in the toe stop bearing surface. In FIG. 6, an array of three projecting ribs 102 radiating outwardly from the periphery of the bore are provided in the bearing surface 98. One who had purchased a roller skate with such a toe stop bearing surface construction and who wished to use the usual toe stop would purchase a toe stop of the type illustrated in FIG. 3 which is adapted to engage the projecting ribs on the roller skate toe stop bearing surface. In any case, regardless of the nature of the toe stop bearing surface, if the bore integral with the toe stop shoulder, such as bore 100 in FIG. 6, is only ¼ inch in diameter, the use of toe stops having a larger diameter mounting stud is not possible. To overcome this problem, the toe stop converter 90 of the present invention can be engaged with the ¼ inch diameter bore in the roller skate and the adjustable toe stop having a larger diameter mounting stud can then be engaged with the converter as will next be explained.

Specifically, the converter is preferably a counterbored member which is substantially cylindrical in shape with an upper end wall 104 and a lower end wall 106. The upper end wall 104 presents an upper end surface 105 and defines a bore 108, a "second" bore as distinguished from the first bore 100 integral with the roller skate toe stop mounting shoulder 92 (FIG. 7). The lower end wall 106 presents a lower end surface 107 and defines a third bore 110 which has a diameter greater than the second bore 108. The bore 110 is coaxial with the bore 108 and communicates with the bore 108 thereby defining an annular shoulder 112. A bolt 114 is inserted in the converter 90 so its shank passes through the second, or smaller, bore 108 and so that the bearing surface of the bolt head bears against the annular shoulder 112. The bolt 114 has a diameter and thread configuration which allows it to be threadingly engaged with the first bore 100 in the roller skate toe stop mounting shoulder 92 so that the converter 90 may be drawn tight thereagainst.

To accommodate the various anti-rotation protuberances which may project from the roller skate toe stop bearing surfaces, such as protuberances 102 in FIG. 6, the upper end wall 104 of the converter 90 has an array of channels 116 radiating outwardly from the bore 108. By appropriate placement of the channels 116 in the upper end surface 105 of the upper wall 104, a single converter 90 can be used with a number of different types of roller skates which have different anti-rotation projections on the toe stop mounting shoulder bearing surfaces. For example, the array of channels 116 in the converter upper end surface 105, illustrated in FIG. 8, will accommodate the array of hemispherical protuberances 40 illustrated on the toe stop bearing surface 34 in FIG. 2 as well as the projecting ribs 62 illustrated on the toe stop bearing surface 52 in FIG. 3. As will be seen, the array of channels 116 in the converter upper end surface 105 would also accommodate an array of four equally spaced hemispherical protuberances of the same type as the three protuberances that are shown on toe stop bearing surface 34 in FIG. 2.

In order to accommodate proper operation of the bolt 114, the bore 108 is typically slightly larger than both the shank of the bolt 114 and the receiving bore 100 in the roller skate toe stop mounting shoulder 92. However, the bore 108 cannot be so large as to allow the head of the bolt 114 to pass therethrough. The diameter of the third bore 110 is larger than the first bore 100 in the roller skate toe stop mounting shoulder 92 and is also larger than the second bore 108 in the converter. Specifically, the bore 110 has a diameter and thread arrangement which accommodates the larger stud 96 of a second "adjustable" toe stop 94 which may be threadingly engaged therewith.

The depth of the bore 110 is sufficient to allow the desired amount of height adjustability of the toe stop 94 with respect to the floor. The stud 96 is threadingly engaged until the bottom of the toe stop 94 is at the desired height above the floor and then the stud is securely clamped within the toe stop converter by means of a threaded clamp screw 118 which draws portions of the converter toward each other to tightly grip the stud 96. To this end, a portion 120 of the lower end wall 106 is flexibly hinged to the remainder of the lower wall and is separated on two sides from the remainder of the lower wall by a vertical slot 122 running substantially parallel to the axis of the bore 110 and by a horizontal slot 124 running substantially perpendicular to the axis of the bore 110. The wall portion 120 flexibly bends in the region of the lower end wall at the end of the slot 124 under influence of the threading force of the clamp screw 118. The wall portion 120 bends inwardly towards the axis of the bore 110, decreasing the width of the slot 122 and clamping tightly against the stud 96 to thereby prevent the stud 96 and toe stop 94 from rotating relative to the bore 110.

Thus, it is seen how the converter of the present invention provides a novel means whereby a single novel structure may be used with a variety of different roller skates having different toe stop anit-rotation protuberance arrays to effectively convert a roller skate having a "small" diameter integral toe stop receiving bore to a skate adapted for receiving a second, "adjustable" toe stop with a mounting stud of a diameter larger than the integral toe stop receiving bore.

The above detailed description has been given for ease of understanding only. No unnecessary limitations are to be understood therefrom, as modifications will be obvious to those skilled in the art.

What is claimed is:

1. An adjustable toe stop converter for converting a roller skate from use with a first toe stop having a threaded mounting stud of a given diameter and thread to use with a second toe stop having a threaded mounting stud of a diameter larger than the mounting stud of said first toe stop, said skate having on its forward end a toe stop mounting shoulder presenting a generally downwardly and forwardly facing toe stop bearing surface and defining a first threaded bore of a diameter and thread equal to that of the threaded mounting stud of said first toe stop, said toe stop converter comprising:

(a) a counterbored member having at one end wall an upper end surface adapted to matingly abut said roller skate toe stop bearing surface and having at the opposite end wall a lower end surface, said one end wall defining a second bore having a second diameter at least equal to the diameter of said first bore in said roller skate toe stop mounting shoulder and less than the diameter of the mounting stud of said second toe stop, said opposite end wall defining a third threaded bore having a diameter and thread equal to that of the mounting stud of said second toe stop, said third bore being coaxial and communicating with said second bore to define an annular shoulder between said second and third bores;

(b) a bolt having a head of a diameter greater than that of said second bore and having a shank with a diameter less than that of said second bore, said shank having threading means adapted to threadingly engage said first bore in said roller skate toe stop mounting shoulder; and (c) means for securing the threaded mounting stud of said second toe stop against rotation within said third bore when said stud of the second toe stop is threadingly engaged therewith, whereby said bolt can be inserted into said counterbored member with the bearing surface of the bolt head bearing against said annular shoulder in the counterbored member and with the shank projecting from said second bore to threadingly engage said first bore in said roller skate toe stop mounting shoulder for matingly abutting said upper end surface of the counterbored member against said roller skate toe stop bearing surface, said stud of the second toe stop can be threadingly engaged with said third bore to adjustably position said second toe stop relative to said roller skate at a distance from said counterbored member lower end surface that is variable with the amount of thread engagement, and said stud of the second toe stop can be secured in the desired position by said securing means.

2. The adjustable toe stop converter in accordance with claim 1 in which a portion of said opposite end wall defining said third bore in said counterbored member is flexibly hinged to the remainder of said end wall, and which includes a screw secured between said flexibly hinged wall member and the remainder of the counterbored member for tightening and holding said wall member against said threaded mounting stud of said second toe stop.

3. The adjustable toe stop converter in accordance with claim 2 in which said flexibly hinged portion of said end wall is separated at its free end from the remainder of the counterbored member by a slot running substantially parallel to the axis of said third bore.

4. The adjustable toe stop converter in accordance with claim 3 in which said flexibly hinged portion of said end wall is further separated from the remainder of the counterbored member by a slot running substantially perpendicular to the axis of said third bore.

5. The adjustable toe stop converter in accordance with claim 1 in which said skate toe stop bearing surface has one of an array of hemispherical protuberances and an array of projecting ribs radiating outwardly from the periphery of said first bore and in which said upper end surface of the counterbored member has channels radiating outwardly from the periphery of said second bore and adapted to engage said protuberances and said projecting ribs for locking said counterbored member against rotation relative to said skate.

* * * * *

UNITED STATES PATENT AND TRADEMARK OFFICE

CERTIFICATE OF CORRECTION

PATENT NO. : 4,094,525

DATED : June 13, 1978

INVENTOR(S) : Cecil E. Davis

It is certified that error appears in the above-identified patent and that said Letters Patent are hereby corrected as shown below:

Column 1, line 13, "skates" should be --skate--;

Column 2, line 18, "desired" should be --desirable--;

Column 2, line 47, "10" should be --¼--;

Column 2, line 49, delete "¼" at the end of the sentence;

Column 3, line 51, "threaded" should be --thread--.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*